United States Patent [19]

Hudson, Jr.

[11] Patent Number: 5,027,261

[45] Date of Patent: Jun. 25, 1991

[54] NON-GLARE NIGHT READER

[76] Inventor: Walter Hudson, Jr., 1104 N. Pkwy. #54, Jackson, Tenn. 38305

[21] Appl. No.: 557,730

[22] Filed: Jul. 26, 1990

[51] Int. Cl.[5] ..... A47B 19/00

[52] U.S. Cl. ..... 362/98

[58] Field of Search ..... 362/98, 99, 31, 227, 362/235, 240, 157

[56] References Cited

U.S. PATENT DOCUMENTS

| | | | |
|---|---|---|---|
| 3,500,034 | 3/1970 | Bissell | 362/98 |
| 3,790,770 | 2/1974 | Stern | 362/98 |
| 3,808,415 | 4/1974 | Hurst | 362/99 |
| 4,364,596 | 12/1982 | Geisendorfer | 362/31 |
| 4,751,615 | 6/1988 | Abrams | 362/98 |

FOREIGN PATENT DOCUMENTS

| | | | |
|---|---|---|---|
| 1232977 | 5/1971 | United Kingdom | 362/98 |

*Primary Examiner*—Ira S. Lazarus
*Assistant Examiner*—Richard R. Cole
*Attorney, Agent, or Firm*—Eugene M. Bond

[57] ABSTRACT

This invention relates to a reading aid having substantially non-glare, with controlled directional light for restrictive light reading. The present non-glare night reader includes a plurality of lights disposed within the body of the reader, and about the peripheral edges thereof. In a preferred embodiment, the present non-glare reader includes a unitary frame and handle, the frame having either four or five sides each of which defines a perimeter of the night reader. In the five-sided embodiment, the reader has two perimeter edges disposed angularly such that when in combination with a receptive stand, the combination provides a convenient storage facility for the night reader. In both the four and five sided embodiments, there is disposed within the inner edge of the frame, a plurality of miniature light bulbs which are connected to a suitable source of electricity. The frame is typically opaque on the upper surface to shield the bulbs from the reader, and to further encloses a low glare glass pane, if desired.

5 Claims, 2 Drawing Sheets

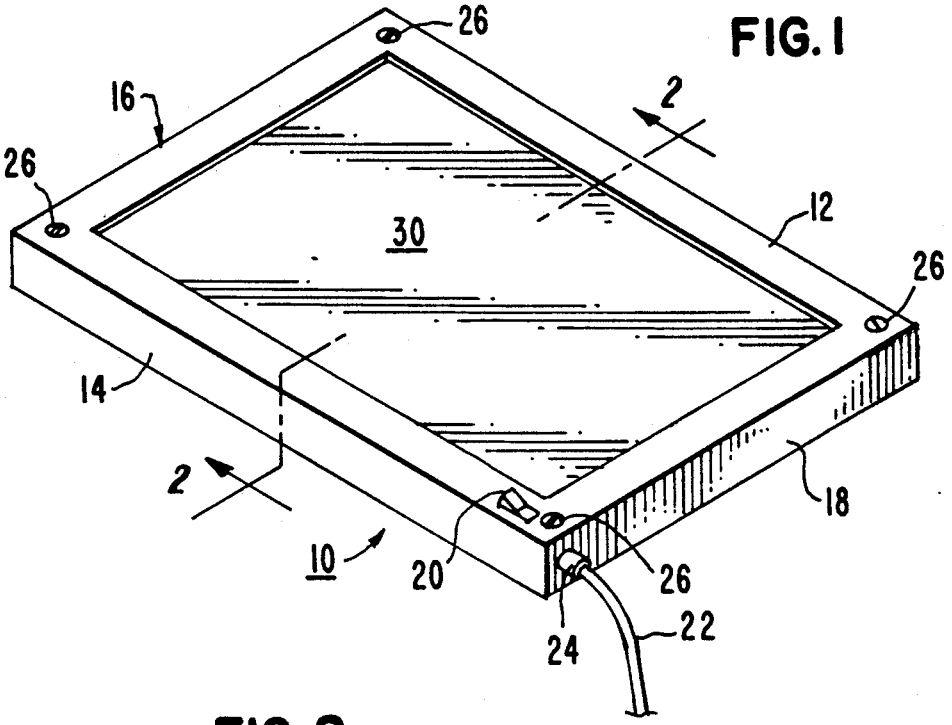
FIG. 1
FIG. 2
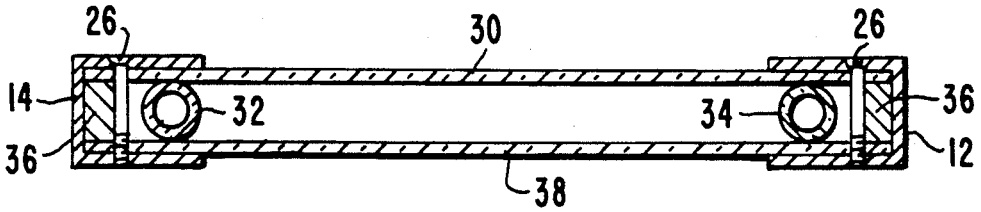
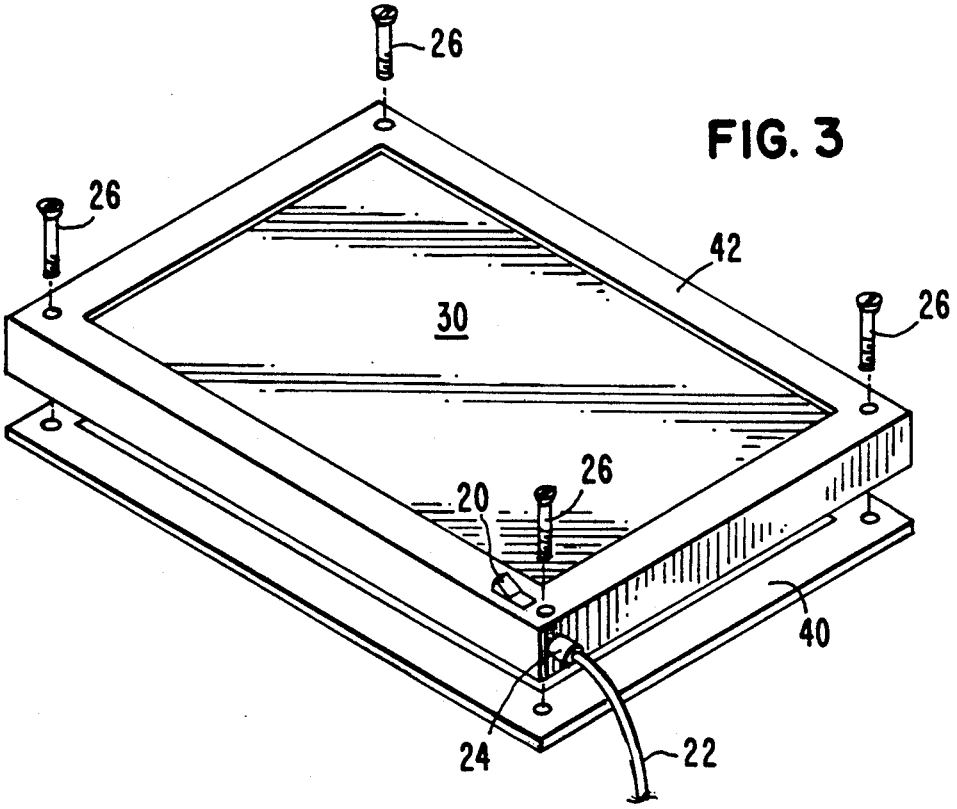
FIG. 3

NON-GLARE NIGHT READER

BACKGROUND OF THE INVENTION

This invention relates to a non-glare night reader which is particularly useful for low light reading environments without distracting an adjacent person who desires to benefit from the low light environment.

Numerous attempts have been made in the prior art to produce devices which control light rays for special reading purposes. For example, U.S. Pat. No. 4,184,194 teaches a self-energized portable high density light display unit which includes a high intensity light disposed for reading X-ray film, photographic films, and the like. This type of device uses benefit of light to read a transparency disposed on the surface of a clear glass support.

Another attempt at controlled light reading devices may be classified generally as light aided magnifying glass readers which are designed to benefit readers having impaired vision. Typically, these devices include a single light source disposed from within an integral handle with the light being reflected about a hood which supports the magnifying glass.

SUMMARY OF THE INVENTION

Generally stated, the present invention provides a non-glare night reader which includes a multi-sided external frame, the upper surface of which is opaque to light; a translucent plate disposed within the upper surface of the multi-sided external frame; a plurality light source disposed within the multi-sided frame, and about the inner peripheral area thereof and; means for providing a source of power source for illuminating the light source.

In a preferred embodiment, the present invention provides a non-glare night reader which includes a unitary frame and handle, the frame having either four or five outer edges. In the five edge embodiment, two outer edges are angled such that in combination with a legged stand serves as a storage facility for the reader. Within the inner edge of the frame, there is disposed a plurality of miniature light bulbs which are connected to a suitable source of electricity. The frame, which may be opaque to shield the reader from light from the bulbs, further encloses a low glare glass panel, magnifying glass, or the like if desired.

In accordance with the present invention, various objects and advantages will become more apparent from the following specification, detailed description and appended claims.

By practice of the present invention and using the apparatus disclosed, it is possible for a reader to read material under a low light environment without disturbing the low light environment of an adjacent person. The present non-glare night reader is particularly useful for night reading in bed, and without disturbing a sleeping partner. Likewise, the present non-glare night reader has great utility for reading during movie flights in airplanes, by way of example. Numerous other darkened reading environments for which the present invention has great utility will become readily apparent to those skilled in the art.

One of the objects of this invention is to provide an improved night reader which is simple, efficient and yet without experiencing deficiencies known in the prior art devices.

Another object of the present invention is to provide an improved night reader which is low to no glare and which provides a reader with clear unobstructed vision without having light interference to adjacent individuals.

Yet another object of the present invention is to provide a non-glare night reader having five sides, two sides of which are V-angled such that in combination with a receptive stand, provides a convenient storage facility.

These and other objects and advantages will become readily apparent to those skilled in the art from consideration of the following more detailed specification.

DETAILED DESCRIPTION OF THE PRESENT INVENTION

Practice of the present invention will become more readily apparent from the following detailed description wherein similar elements are represented by like numerals through the several views, all taken in conjunction with the drawings wherein:

FIG. 1 is a top perspective view of the non-glare reader device of the present invention;

FIG. 2 is a half side elevation view taken along section lines 2—2 of FIG. 1;

FIG. 3 is a top elevation view of the present reader of FIG. 1 in partial exploded perspective;

Figure 4:
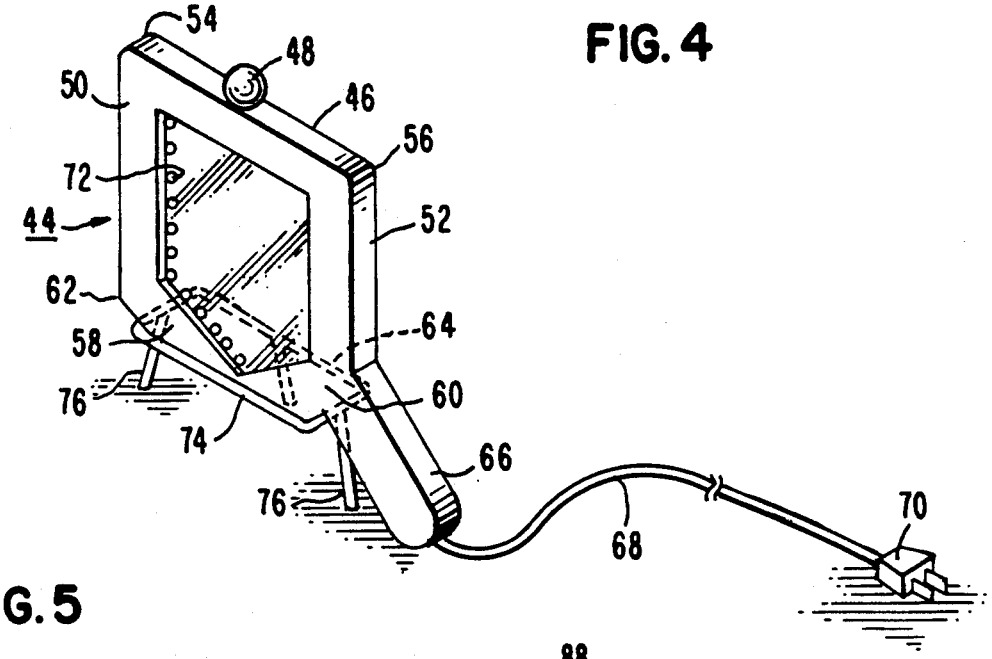
FIG. 4 is an embodiment of the present non-glare reader in combination with a support stand.

With specific reference to FIG. 1, the present invention is illustrated as non-glare night reader 10 having right and left side members 12 and 14 respectively; and top and bottom edges 16 and 18 respectively. Preferably, the top face surfaces of the side members and that of the edges are dark colored such that light from the inner portion of the night reader is confined to within the unit itself, and directed onto the surface of that which is being read. The lights which are used within the night reader may be from any convenient, suitable, and commercially available source. These lights may be powered by either AC or DC current, controlled by on-off switch 20. When AC current is used, the current is received through line 22 from a conventional outlet. Line 22, for illustration purposes, originates through bottom edge 18 where it projects from an opening where it is protected from wear by sleeve 24. Although not necessary for construction purposed, non-glare night reader 10 is illustrated having corner bolts 26 which secure the unitary configuration of the structure, while supporting upper glass layer 30 in relative position. Glass 30 may be plane glass, low glare glass, or magnifying glass as desired.

FIG. 2 presents a side sectional view taken along sectional line 2—2 of FIG. 1, and further illustrates the configuration of non-glare night reader 10.

With reference to FIG. 2, non-glare night reader 10 is further illustrated as the internal configuration, showing a plurality of lights 32 and 34 positioned about the periphery of the non-glare night reader 10, within the unit, and respectively along left side member 14 and right side member 16. Spacer 36 may be used along the inner edges to enhance the strength in the area of bolt 26, while providing a separating means for upper glass layer 30 and lower glass layer 38. Lower glass layer is included optionally and may be formed of clear glass for ease of reading. Bolt 26 may be secured by any desirable means to the lower frame of the side members, such as by seating means directly with the frame itself. Numerous other means may be used readily in construction without departing form practice of the present invention.

FIG. 3 illustrates a non-glare night reader 10 of the present invention, except having a bottom frame 40 which is used to contain the lower glass layer 38 in position onto a mating frame 42.

FIG. 4 illustrates an embodiment non-glare night reader 44, of the present invention, wherein the night reader has integral frame member 46 along the upper side which contains an on-off switch 48. Integral frame member 46 joins vertically disposed leg members 50 and 52, at near right angles at edges 54, and 56, respectfully. The lower portion of the integral frame is defined by modified V-shaped members defined by projecting lower leg members 58 and 60, with lower leg member 58 joining vertically disposed leg member 50 at an angle at union 62, and lower leg member 60 forming an integral junction 64, along with handle 66, and vertically disposed leg member 52. Although non-glare night reader 44 is illustrated with cord 68, and electrical plug 70, it is apparent that the source of power may be a battery positioned within handle 66, or alternatively, the source of power may be a rechargeable power source disposed conveniently in handle 66, by way of example. The lighting configuration for the multiple bulbs in non-glare night reader 44 are illustrated simply as bulbs 72, and will be more clearly illustrated with reference to FIG. 6, subsequently.

In FIG. 4, combination of the modified V-shaped members and rectangular storage receptacle 74 serves to provide a convenient means for storage of non-glare night reader 44. Rectangular storage receptacle 74 includes a rod shaped support surface 74 having projecting support legs 76. The angle at which handle 66 is positioned, and the length thereof is such that handle 66 stabilizes non-glare night reader 44 onto a support surface such as a night stand, when is the storage position.

Figure 5:
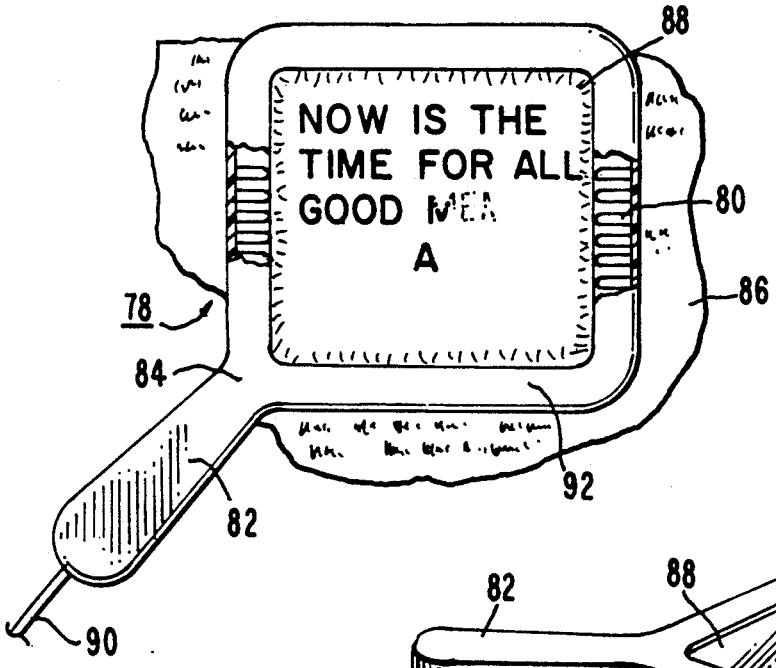
FIG. 5 is a view of the present non-glare reader illustrated in a reading perspective.

FIG. 5 illustrates non-glare night reader 78 with partial section removed to illustrate the plurality of bulbs 80 disposed about the inner peripheral boundary. The embodiment of FIG. 5 represents a four-sided reader with handle 82 positioned conveniently at an angle from corner 84 thereby providing a square reading of print 86 magnified by suitable glass surface 88. Although night reader 78 is illustrated as a square, it is readily recognized that the configuration may be rectangular, or constructed as desired for either style or maximum convenience for reading. Cord 90 provides a source of power for lights 80. It has been found that miniaturized bulbs disposed serially or in parallel, form a convenient means for light under the opaque upper surface of frame 92.

Figure 6:
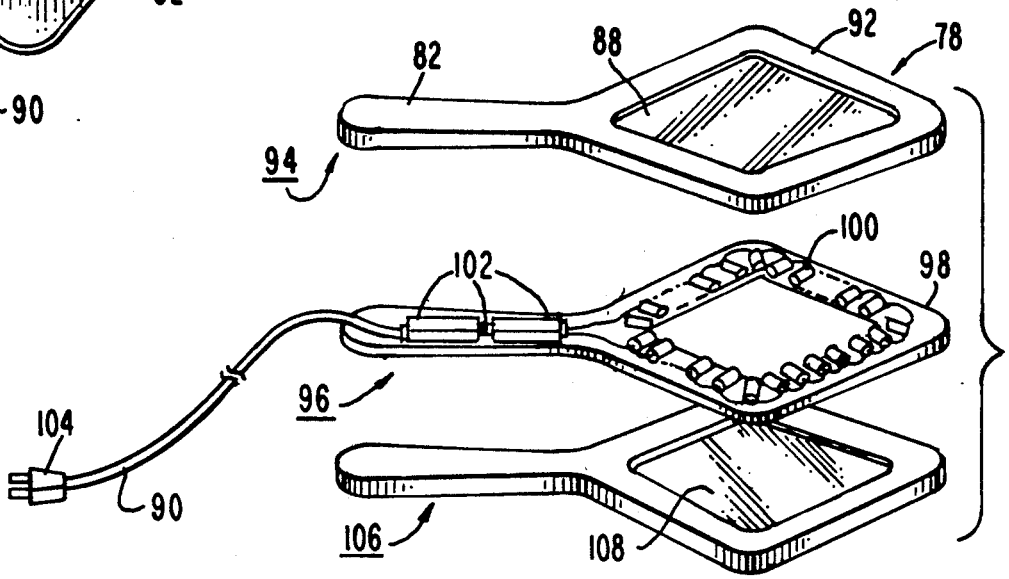
FIG. 6 is an exploded view of the embodiment of FIG. 5, taken to illustrate the internal configuration of the embodiments of the present invention.

FIG. 6 illustrates non-glare night reader 78 in exploded configuration. Non-glare night reader 78 is shown with three basic layered components. The first, upper component layer 94 includes the opaque frame 92 within which is glass surface 88, illustrated as a transparent magnifying glass. The intermediate component layer 96 has intermediate transparent frame 98 positioned to mate with the upper component layer 94, and to support the plurality of miniature bulbs 100, disposed either in series or parallel circuit. Convenient stay members 102 are included to contain cord 90 in position. Cord 90 joins electrical plug 104 for connection to an electrical outlet, not shown. Intermediate transparent frame 98 solely supports miniature bulbs 100, and need not contain a transparent glass plate.

Base component layer 106 is constructed for unitary mating with both intermediate transparent frame 98, and upper component layer 94. Base layer 106 is also transparent to permit light to pass onto the surface which is being read. Within the frame of base layer 106, the structure may include optionally transparent glass 108 which seals the internal unit into a dust free structure. The unitary configuration may be joined as desired to permit replacement of bulbs with the interior, on intermediate transparent frame 98.

It is apparent that the three component layers are shaped similarly for mating into a unitary structure.

The various non-electrical components of the present device may be constructed from metal or plastic, as desired. The viewing glass may be constructed of plastic, magnified or plain, but is preferably glass for reading clarity.

It will be apparent to those skilled in the art that various changes and modifications may be made in the details of the specification without departing from the spirit of the invention and as either disclosed or claimed.

What is claimed is:

1. A non-glare night reader which comprises:

(A) a unitary frame and handle, said handle joined exterior to a multi-sided external frame, the upper surface of said frame being opaque to light;

(B) a transparent plate disposed within the upper surface of the multi-sided external frame;

(C) a plurality light source disposed within the multi-sided frame, and about the inner peripheral area thereof;

(D) means for providing a source of power source for illuminating the light source; and (E) wherein the multi-sided external frame has five sides each of which define a perimeter of the reader and wherein two of the sides have a modified V-shaped configuration and the remaining three sides are disposed at right angles to each other.

2. The night reader of claim 1 wherein the modified V-shaped configuration provides a means for storage of the reader in a vertical position when disposed in combination with a mating support stand having projecting leg members.

3. The night reader of claim 1 wherein the power source is an AC source.

4. The night reader of claim 1 wherein the power source is a DC source.

5. The night reader of claim 1 wherein a handle projects from one union of the V-shaped configuration and the remaining three sides.

* * * * *